US006089367A

United States Patent [19]

Anderson et al.

[11] Patent Number: 6,089,367

[45] Date of Patent: Jul. 18, 2000

[54] SECUREMENT OF A PAD TO THE INSIDE OF A BAG

[75] Inventors: Richard Floyd Anderson, Alpharetta, Ga.; Michael A. Bullock, McComb, Miss.

[73] Assignee: Pac One, Inc., Dunwoody, Ga.

[21] Appl. No.: 09/330,964

[22] Filed: Jun. 11, 1999

[51] Int. Cl.[7] ..... B65D 81/26

[52] U.S. Cl. ..... 206/204; 383/109; 383/121; 426/129

[58] Field of Search ..... 156/270, 297, 156/299, 300, 301; 206/204, 594; 383/109, 110, 113, 114, 116, 119, 121; 426/107, 124, 129; 493/210, 217–219; 428/35.2

[56] References Cited

U.S. PATENT DOCUMENTS

| | | | |
|---|---|---|---|
| 2,475,359 | 7/1949 | Piazze . | |
| 3,156,402 | 11/1964 | Dupuis . | |
| 3,809,223 | 5/1974 | Kendall | 206/204 |
| 4,275,811 | 6/1981 | Miller . | |
| 4,321,997 | 3/1982 | Miller . | |
| 4,382,507 | 5/1983 | Miller . | |
| 4,401,213 | 8/1983 | Lerner . | |
| 4,410,578 | 10/1983 | Miller . | |
| 4,619,361 | 10/1986 | Thomas, Jr. . | |
| 4,720,410 | 1/1988 | Lundquist et al. . | |
| 4,742,908 | 5/1988 | Thomas, Jr. et al. . | |
| 4,756,939 | 7/1988 | Goodwin . | |
| 4,813,791 | 3/1989 | Cullen et al. . | |
| 4,815,590 | 3/1989 | Peppiatt et al. . | |
| 4,852,732 | 8/1989 | Wilski et al. . | |
| 4,860,887 | 8/1989 | Fosse . | |
| 4,861,632 | 8/1989 | Caggiano . | |
| 4,897,273 | 1/1990 | Kotaki et al. . | |
| 5,226,735 | 7/1993 | Beliveau . | |
| 5,404,999 | 4/1995 | Bednar . | |
| 5,415,475 | 5/1995 | Sandy . | |
| 5,454,601 | 10/1995 | Sekine et al. . | |
| 5,660,868 | 8/1997 | Yeager . | |
| 5,839,572 | 11/1998 | Yeager . | |
| 5,845,769 | 12/1998 | Yeager . | |
| 5,882,464 | 3/1999 | Theisgen et al. | 156/301 |

FOREIGN PATENT DOCUMENTS

| | | |
|---|---|---|
| 2 189 276 | 6/1972 | France . |
| WO98/41116 | 3/1998 | WIPO . |
| WO 98/25835 | 6/1998 | WIPO . |

*Primary Examiner*—Jim Foster
*Attorney, Agent, or Firm*—Kennedy Covington Lobdell & Hickman

[57] ABSTRACT

A storage bag formed from a thermoplastic film includes a pad secured to the inside bottom thereof. The pad is disposed adjacent the bag material at or near the bottom by one or more strips of material extending across the pad. Each strip has an intermediate portion extending over the pad and two opposed portions each affixed on opposite sides of the intermediate portion to the bag material. If a single strip is used to secure the pad, the single strip has a sufficiently narrow width that the pad extends preferably beyond the strip on opposite sides of the intermediate portion. If two strips are used to secure the pad, each strip is disposed at a spacing to the other in extending over the pad. Thus, in either case at least part of the pad is exposed and uncovered by the strips of material. The method of making the bag includes placing the pad adjacent the bag material; placing one or more strips of a material across the pad with an intermediate portion of each strip extending over the pad and with two opposed portions of each strip extending on opposite respective sides of the intermediate portion beyond the pad; and, affixing the two opposed portions of each strip of material to the bag material to thereby secure the pad to the bag material. The bag material and pad are then folded along a common fold line to form the bottom of a bag.

17 Claims, 3 Drawing Sheets

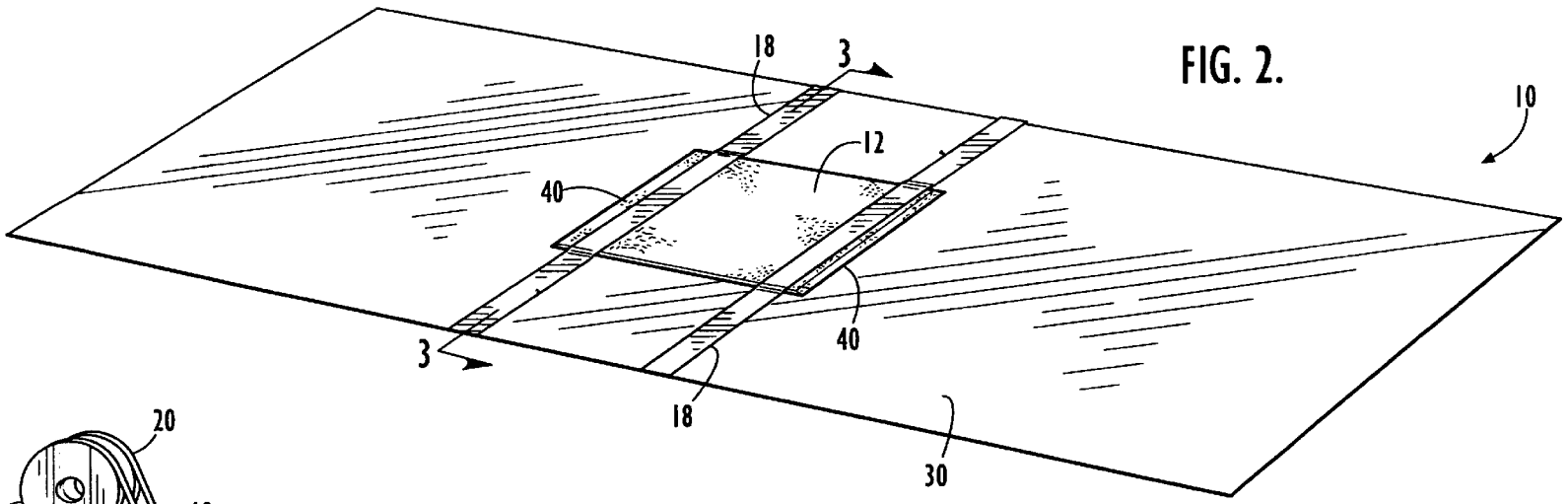
FIG. 2.
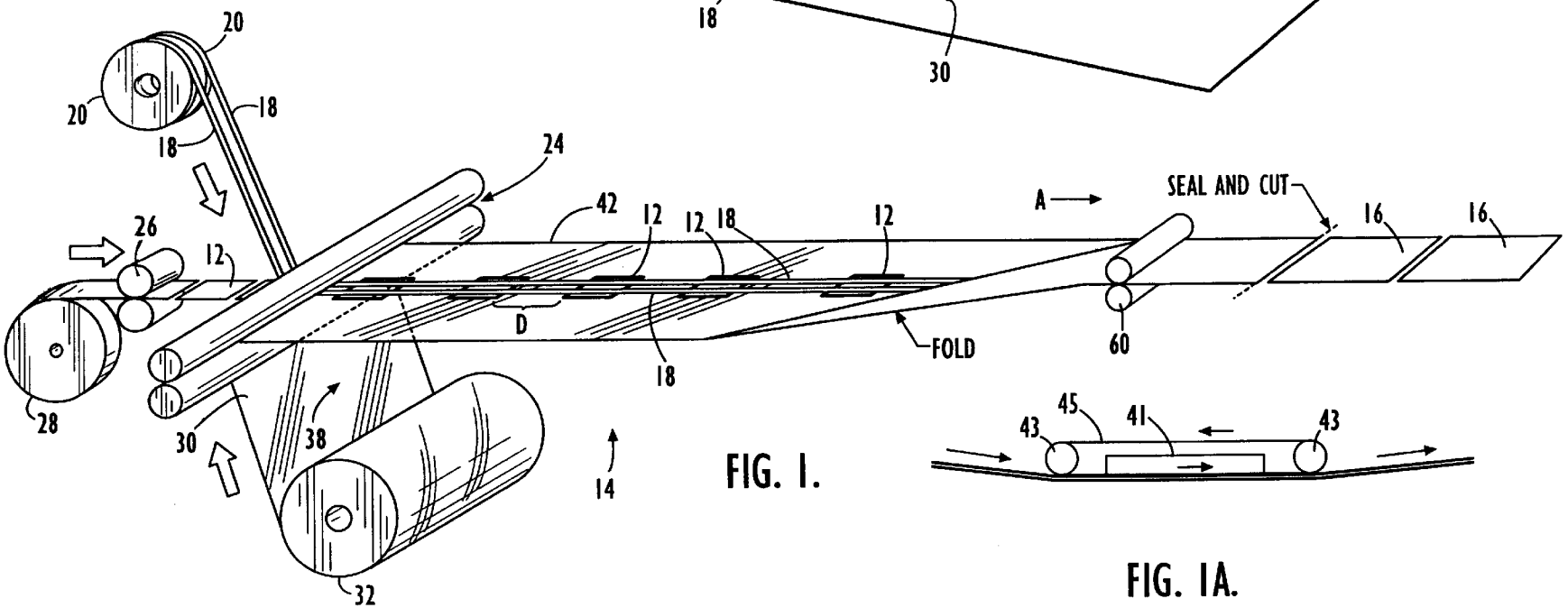
FIG. 1.
FIG. 1A.

SECUREMENT OF A PAD TO THE INSIDE OF A BAG

FIELD OF THE PRESENT INVENTION

The present invention relates broadly to the securement of a pad to the inside of a bag. Preferably, the pad is an absorbent pad used in food storage bags for poultry and is commonly referred to as a "soaker pad"; however, the present invention is further applicable to the securement of any other type of pad within any type of bag such as, for example, a pad having disinfectants secured to the inside of storage bag for medical equipment; a pad having antimicrobial agents secured to the inside of a food storage bag; a pad having moisturizing agents secured to the inside of a storage bag for tobacco products; or a pad having desiccants secured to the inside of a storage bag for electronic components.

BACKGROUND OF THE PRESENT INVENTION

With particular regard to food storage bags, it is well know in the art of plastic bag manufacturing to include an absorbent pad within the bag for absorbing any fluids that may emanate from the food. This is especially the case when the food is beef or poultry, which exudes blood and other fluids that may be unsightly or that may include bacteria or otherwise pose a health risk.

Traditionally, soaker pads have simply been heat welded to one or more walls of material forming the bag. A recent improvement to the art of securing soaker pads to bags is found in Yeager U.S. Pat. No. 5,660,868 (the '868 Patent). In particular, an enclosure containing a soaker pad is provided in the bottom of the storage bag in the '868 Patent. The enclosure is formed by sealing a perforated film about its perimeter to the front and rear panels of the bag whereby fluid must pass through the perforated film to reach the soaker pad disposed in the enclosed space. The defining of the enclosed space by the perforated film is important, as not only does the soaker pad serve to retain fluids, but the enclosed space itself acts a fluid sump or reservoir. Improvements to the bag of the '868 Patent are also found in U.S. Pat. Nos. 5,845,769 and 5,839,572, both to Yeager.

While the storage bag disclosed by the '868 Patent, and further improvements thereto, have been well received by food packagers, a need remains for a simpler and more efficient method of securing an absorbent pad within a storage bag, especially when a fluid sump or reservoir is not desired and the materials therefor present an unnecessary cost.

SUMMARY OF THE PRESENT INVENTION

Briefly described, the present invention relates to the securement of a pad to a bag. A method of the present invention includes the steps of: placing the pad adjacent the bag material; placing one or more strips of a material across the pad with an intermediate portion of each strip extending over the pad and with two opposed portions of each strip extending on opposite respective sides of the intermediate portion beyond the pad; and, affixing the two opposed portions of each strip of material to the bag material to thereby secure the pad to the bag material. Preferably, the bag and each strip are formed from a thermoplastic material and the affixing of the strip to the bag material is by conventional heat sealing. Alternatively, the strips preferably include an adhesive for adherence to the bag material.

The bag of the present invention includes a pad secured to the inside bottom thereof. The bag itself is preferably formed from a thermoplastic film and the pad is disposed adjacent the bag material at or near the bottom with one or more strips of material extending across the pad, with each strip having an intermediate portion extending over the pad and two opposed portions each affixed on opposite sides of the intermediate portion to the bag material. If a single strip is used to secure the pad, the single strip has a sufficiently narrow width that the pad extends beyond the strip on opposite sides of the intermediate portion. If two strips are used to secure the pad, each strip is disposed at a spacing to the other in extending over the pad. Thus, in either case, at least part of the pad remains exposed and uncovered by the strips of material.

In a feature of the present invention, opposed portions of a strip of material are affixed to the bag material at spacings sufficiently close to the pad to at least slightly compress the pad and bag material together.

In another feature of the present invention, a strip of material completely covers over a side edge of the pad.

In yet another feature, substantially the entire opposed portions of a strip of material are heat sealed to the bag material.

In another feature, the intermediate portion of the strip of material is heat sealed to the pad; alternatively, the intermediate portion of the strip of material is not heat sealed to the pad. In either case, however, the intermediate portion of the strip is not heat sealed to the bag material.

The present invention also relates to a method of making a bag which itself includes the aforesaid method of securing the pad to the bag material. In the bag making method, the further step is performed of folding the bag material and pad along a common fold line to form a bottom of the bag. Preferably, the fold line extends parallel to a strip of material.

The present invention also relates to the inline method of securing absorbent pads to a web of material used to make bags based upon the aforesaid basic method of securing a pad to a bag material. The inline process is used in mass-producing bags of the present invention.

BRIEF DESCRIPTION OF THE FIGURES

Further features, embodiments, and advantages of the present invention will become apparent form the following detailed description with reference to the drawings, wherein:

FIG. 1 is a perspective view of a method of the present invention;

FIG. 1A is a side elevational view of an alternative method of FIG. 1 for securing a strip of material to the bag material;

FIG. 2 is a perspective view of a bag material having an absorbent pad secured thereto in accordance with the present invention;

DETAILED DESCRIPTION OF PREFERRED EMBODIMENTS

Figure 3:
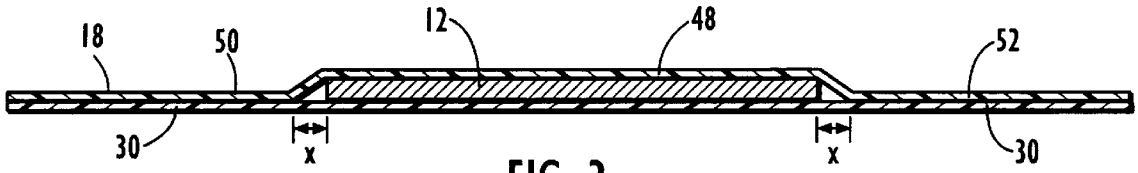
FIG. 3 is a cross-sectional view of the bag material, absorbent pad, and a strip of material of FIG. 2 taken along the line 3—3.

Preferred embodiments of the present invention will now be described in detail with reference to FIGS. 1–9. Furthermore, like structures will be identified by like reference numerals in the illustrated embodiments of FIGS. 1–9.

As shown in FIG. 1, a plurality of individual bags 16 each having an absorbent pad 12 secured thereto are mass-produced in an inline process 14 of the present invention. In the process two strips 18 of material of indefinite length each are continuously conveyed from separate stock rolls 20 to a pair 24 of rollers. An indefinite length of a pad material is also fed intermittently at a predetermined time interval from a stock roll 28 to the pair 24 of rollers by pad index rollers 26. A cutting device (not shown) is associated with the pad index rollers 26 and severs the indefinite length of the pad material into individual pads 12 having a predetermined length. Each pad 12 is then delivered at the predetermined time interval to the pair 24 of rollers.

Simultaneously, a bag material 30 is continuously conveyed from a stock roll 32 thereof also to the pair 24 of rollers and then through and from the pair 24 of rollers in a longitudinal direction "A." Each pad 12 intermittently delivered from the pad index rollers 26 is passed through the pair 24 of rollers in abutment with the bag material 30 with each pad 12 longitudinally spaced on the bag material 30 a predetermined distance "D" between consecutive pads 12. The pad index rollers 26 insure that the pad 12 is properly oriented to the bag material 30 preferably to be placed in the center 38 of the indefinite length of the bag material 30.

Each strip 18 of material continuously conveyed to the pair 24 of rollers is also oriented to the pad 12 at the pair 24 of rollers such that each strip 18 of material is placed over and extends across each pad 12 as it is delivered into abutment with the bag material 30, whereby the pad 12 is properly sandwiched between the strips 18 of material and the bag material 30 as it passes through the pair 24 of rollers. Furthermore, the strips 18 of material are relatively positioned to extend over the pad 12 at spacings "S" to the longitudinal sides 40 of the pad as well as in spaced, parallel relation "P" to each other (see FIG. 4). Thus, each strip 18 of material has a sufficiently narrow width "W" that the pad 12 extends beyond opposite longitudinal sides 54 of the portion of the strip 18 of material extending over the pad 12.While passing through the pair 24 of rollers each strip 18 of material is adhered to the bag material 30 to thereby secure each pad 12 to the bag material 30. In the embodiment of the method shown, the pair 24 of rollers compresses the two strips 18 of material, pad 12, and bag material 30 together. In this embodiment, each of the two strips 18 of material preferably includes a pressure sensitive adhesive and the pair 24 of rollers effect a continuous adherence between each strip 18 of material and the bag material 30 disposed between each pad 12. A preferred alternative to the use of an adhesive material is shown in FIG. 1A, wherein each strip 18 of material is heat sealed to the bag material 30 continuously between each pad 12 by an elongate heating bar 41 of a conventional band sealer that extends in the direction of travel of the strip 18 of material. In particular, the heating bar 41 of the band sealer heats an endless belt of Teflon film 45 conveyed by rollers 43 and against which the strip 18 of material and the bag material 30 are tensioned for heat welding of the strip 18 to the bag material 30.

In one feature of the present invention, the adherence between each strip 18 of the material and the pad 12 is also effected. Alternatively, adherence does not result between each strip 18 of material and the pad 12. In either case, however, the adhering of each strip 18 of material to the bag material 30 preferably extends up to a spacing "X" sufficiently close to the pad 12 to at least slightly compress the pad 12 and bag material 30 together, thereby insuring securement of the pad 12 to the bag material 30.

Following the pair 24 of rollers, a web 42 of the bag material 30 having a plurality of absorbent pads 12 results. At this stage the web 42 can be taken-up to form a stock roll in conventional manner (not shown). Alternatively, and preferably, the web 42 can be further processed.

In particular, the web 42 next is preferably folded along a longitudinal axis to bring opposed edges of the web 42 into alignment. Cutting using a hot knife (not shown) to form seals along a direction transverse to the longitudinal direction "A" are next made between each pad 12, whereby individual bags 16 of the present invention are formed. Alternatively, transverse seals are formed without severing of the web 42, whereby a web of a plurality of consecutive bags 16 adjoined along their sides 56 is formed (not shown). This web can then be taken-up for latter packaging or cutting, or alternatively, individual bags 16 can then be cut from the web. In any event, a bottom 46 of the bag 16 having the secured absorbent pad 12 will have been formed in accordance with the present invention.

Figure 4:
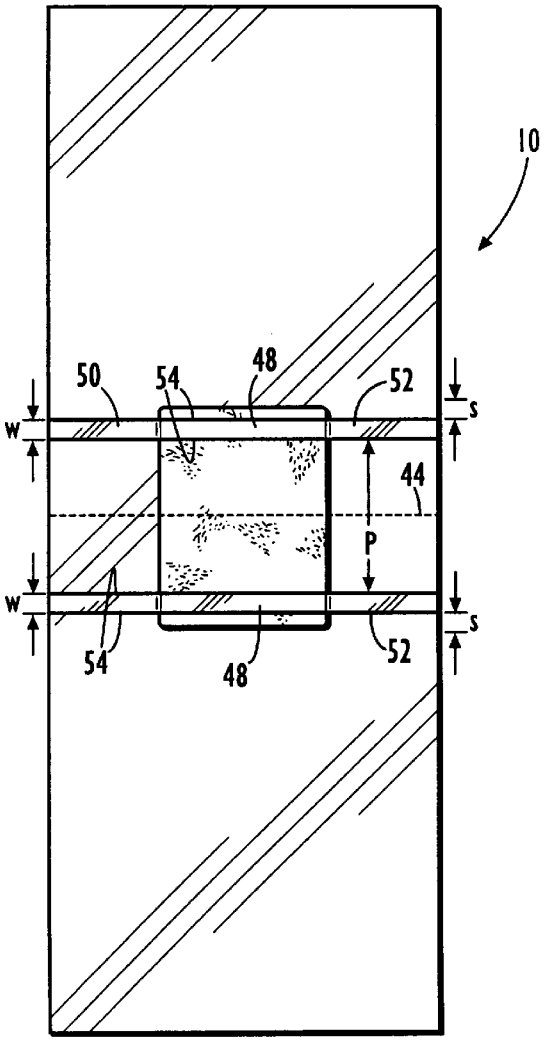
FIG. 4 is a plan view of the bag material having an absorbent pad secured thereto of FIG. 2.
Figure 5:
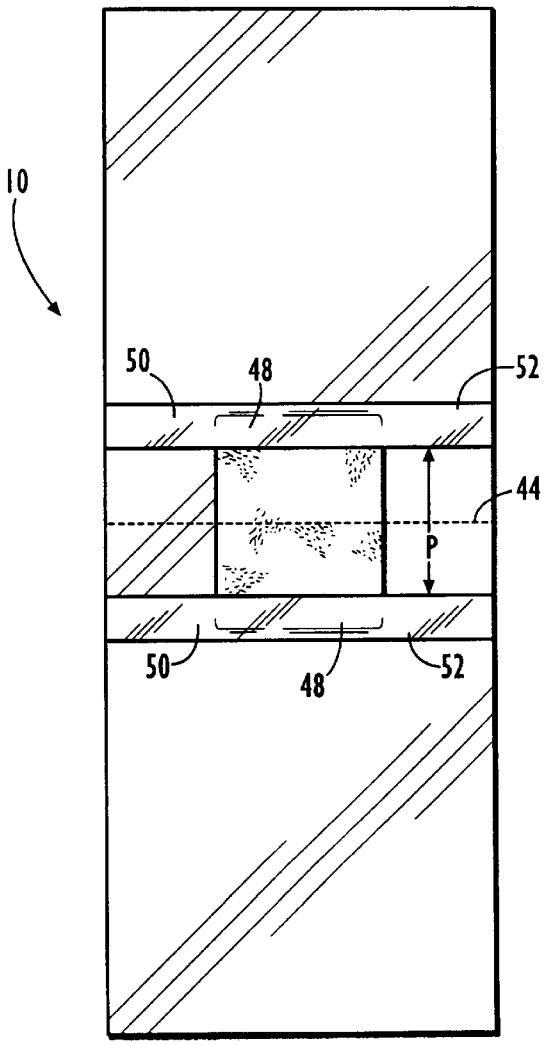
FIG. 5 is a plan view of a bag material having an absorbent pad secured thereto in accordance with another embodiment of the present invention.
Figure 6:
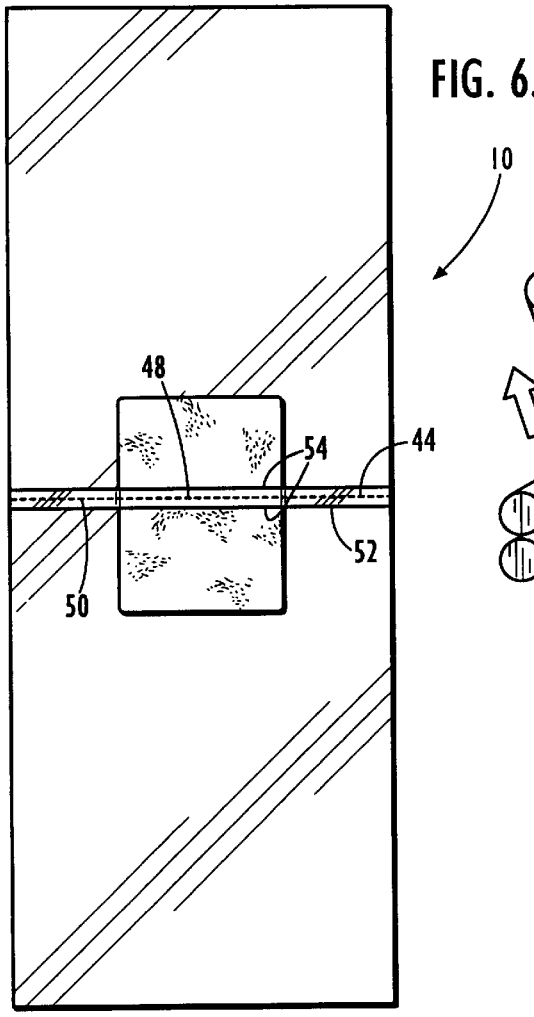
FIG. 6 is a plan view of a bag material having an absorbent pad secured thereto in accordance with yet another embodiment of the present invention.

Alternatively, as will be obvious to one having skill in the art, instead of first folding the web 42 following the adherence of the strips 18 of material to the bag material 30, individual sheets 10 of the bag material 30 with each including the absorbent pad 12 secured thereto can be formed by simply cutting the web 42 in a direction transverse to direction "A" (not shown). Each sheet 10 is then folded about a fold line 44 extending longitudinally across the bag material 30 and pad 12 as shown in FIGS. 4–6 to thereby form a bottom 46 of the bag 16. The resulting bag bottom 46 thus includes two strips 18 of material each extending across the pad 12 with an intermediate portion 48 thereof extending over the pad 12, with two opposed portions 50,52 thereof each adhered on opposite sides of the intermediate portion 48 to the bag material 30 at the spacing "X" sufficiently close to the pad 12 to at least slightly compress the pad 12 and bag material 30 together, and with the pad 12 extending beyond opposite longitudinal sides 54 of the intermediate portion 48 thereof. Folded transverse sides of the sheet 10 are then sealed together to form the sides 56 of the bag 16 of the present invention with the top 58 thereof remaining unsealed and open for the receipt therein of the product to be packaged. Furthermore, preferably each strip 18 of material is planar and relatively thin whereby the additional thickness of the bag 16 at each juncture of the strip 18 of material with each side 56 of the bag 16 is negligible.

In a modified but also preferred embodiment of the present invention as shown in FIG. 5, each strip 18 of material extends completely over and covers respective longitudinal side edges 40 of the pad 12. In yet another modified form, only one strip 18 of material is utilized which is preferably oriented to extend along the fold line 44 of the bag as shown in FIG. 6. Furthermore, the strip 18 of material includes a sufficiently narrow width W that the pad 12 extends beyond opposite sides 54 of the portion 48 of the strip 18 of material covering the pad 12, whereby the pad 12 is exposed to the interior of the bag 16 on opposite sides of the strip 18 of material securing it to the bag 16.

Figure 7:
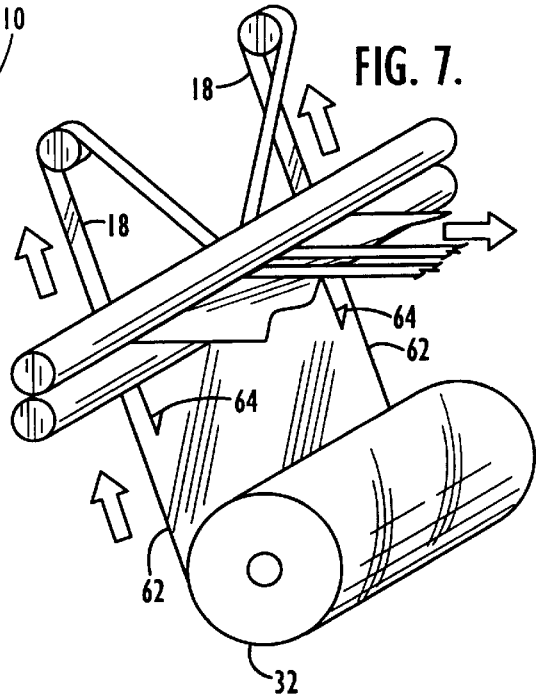
FIG. 7 is a perspective view of an alternative method of FIG. 1 for providing the strips of material.
Figure 8:
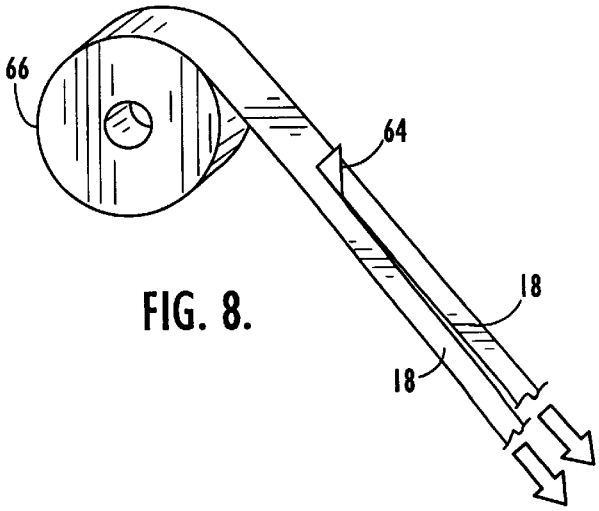
FIG. 8 is a perspective view of still yet another alternative method of FIG. 1 for providing the strips of material.
Figure 9:
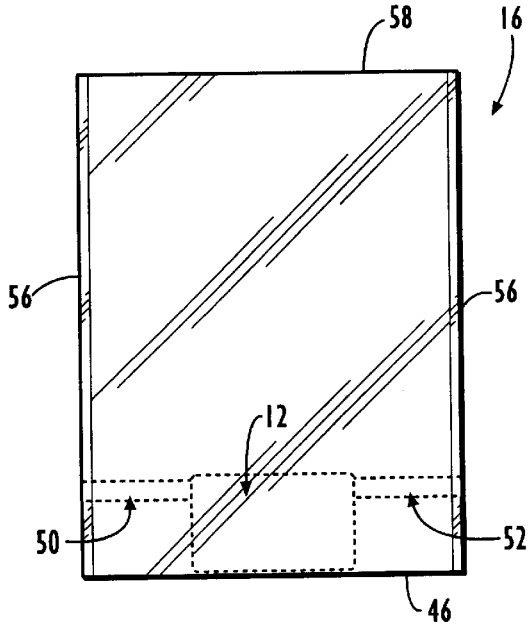
FIG. 9 is a plan view of a bag of the present invention having an absorbent pad secured thereto.

The bag material 30 itself can comprise one of many different conventional materials used to make bags and the strips 18 can be the same as or different from the bag material. Indeed, in a preferred embodiment of the in-line process, each strip 18 of material is actually trimmed from a side 62 of a web of the bag material 30 with blades 64 as it is advanced from the stock roll 32 thereof as shown in FIG. 7; following trimming, the strips 18 are directed back to the pair 24 of rollers as in FIG. 1. In yet another alternative embodiment as shown in FIG. 8, the strips 18 are formed from a single stock roll 66 of material by cutting with a single blade 64 the length of the material in half during unwinding thereof, the strips 18 then being directed to the pair 24 of rollers as in FIG. 1.

It is also contemplated within the scope of the present invention that each strip of material could be affixed to the bag material using some manner of mechanical interlocking means rather than simply adhering the strip of material to the bag material through an adhesive or welding.

It will therefore be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

What is claimed is:

1. A bag bottom having a pad secured thereto, comprising:

a pad disposed adjacent a bag material forming the bag bottom, and a strip of material extending across the pad with an intermediate portion of the strip of material extending over the pad, with two opposed portions of the strip of material each affixed beyond opposite ends of the intermediate portion to said bag material at spacings sufficiently close to the pad to at least slightly compress the pad and bag material together, and with the pad extending beyond the strip of material on opposite sides of the intermediate portion.

2. A bag bottom according to claim 1, wherein said strip is continuously sealed to said bag material except for said intermediate portion thereof extending over said pad.

3. A bag bottom according to claim 1, wherein said intermediate portion of said strip of material is not affixed to said pad.

4. A bag bottom according to claim 1, wherein said intermediate portion of said strip of said material is affixed to said pad.

5. A bag bottom according to claim 1, wherein said bag material and said strip of material both comprise thermoplastic material.

6. A bag bottom according to claim 1, wherein said bag material and said pad are folded along a common fold line to form the bottom of the bag.

7. A bag bottom according to claim 6, wherein said fold line extends parallel to said strip of material.

8. A bag bottom having a pad secured thereto, comprising:

a pad disposed adjacent a bag material forming the bag bottom, and two strips of material extending across said pad with an intermediate portion of each said strip of material extending over said pad and at a spacing to one another, and with two opposed portions of each said strip of material each affixed to said bag material beyond opposite ends of said intermediate portion thereof.

9. The bag bottom of claim 8, wherein said two opposed portions of each said strip of material are each affixed to said bag material on opposite sides of said intermediate portion at spacings sufficiently close to said pad to at least slightly compress said pad and said bag material together.

10. The bag bottom of claim 8, wherein each strip of material has a sufficiently narrow width such that said pad extends beyond each said strip of material on opposite sides of said intermediate portion thereof.

11. The bag bottom of claim 8, wherein each said strip of material completely covers over a side edge of said pad.

12. The bag bottom of claim 8, wherein each said strip is continuously adhered to said bag material except for said intermediate portion thereof extending over said pad.

13. The bag bottom of claim 8, wherein said intermediate portion of each said strip is not affixed to said pad.

14. The bag bottom of claim 8, wherein said intermediate portion of each said strip is affixed to said pad.

15. The bag bottom of claim 8, wherein said bag material and said pad are folded along a common fold line to thereby form the bottom of the bag.

16. The bag bottom of claim 14, wherein said fold line extends parallel to said strips of material.

17. The bag bottom of claim 8, wherein said bag material and said strips of material both comprise thermoplastic material.

* * * * *